US006308438B1

(12) United States Patent
Throneburg et al.

(10) Patent No.: US 6,308,438 B1
(45) Date of Patent: Oct. 30, 2001

(54) SLIPPER SOCK MOCCASIN AND METHOD OF MAKING SAME

(75) Inventors: James L. Throneburg, 635 Hauser Rd., Lewisville, NC (US) 27023; Stanley I. Kravetz, Andover, MA (US); Victor J. Gallenstein, Maysville, KY (US)

(73) Assignee: James L. Throneburg, Lewisburg, NC (US)

( * ) Notice: Subject to any disclaimer, the term of this patent is extended or adjusted under 35 U.S.C. 154(b) by 0 days.

(21) Appl. No.: 09/440,374

(22) Filed: Nov. 15, 1999

(51) Int. Cl.[7] ..... A43B 1/02; A43B 3/14; A43B 13/14

(52) U.S. Cl. ..... 36/9 R; 36/11; 36/26

(58) Field of Search ..... 36/9 R, 11, 84, 36/26, 4, 11.5, 25 R, 28, 30 R, 30 A, 31, 32 R

(56) References Cited

U.S. PATENT DOCUMENTS

| | | | | |
|---|---|---|---|---|
| 897,732 | * | 2/1908 | Busby | 36/31 |
| 4,083,124 | * | 4/1978 | Michalak | 36/9 R |
| 4,768,295 | * | 9/1988 | Ito | 36/28 |
| 4,918,838 | * | 4/1990 | Chang | 36/28 |
| 4,967,494 | * | 11/1990 | Johnson | 36/9 R |
| 5,077,915 | * | 1/1992 | Gross | 36/31 |
| 5,493,791 | * | 2/1996 | Kramer | 36/28 |
| 5,553,399 | * | 9/1996 | Strong | 36/9 R |
| 5,617,585 | * | 4/1997 | Fons et al. | 36/9 R |
| 5,782,014 | * | 7/1998 | Peterson | 36/31 |
| 6,014,821 | * | 1/2000 | Yaw | 36/11.5 |

* cited by examiner

*Primary Examiner*—Paul T. Sewell
*Assistant Examiner*—Anthony Stashick
(74) *Attorney, Agent, or Firm*—Alston & Bird LLP

(57) ABSTRACT

A slipper sock having improved wearer comfort and providing enhanced foot protection is described. The slipper sock includes a sock having thickened padded portions along the ball and heel portions, with a relatively thinner arch portion therebetween. The device also includes a footbed having a first receptacle for underlying the ball portion of the sock and a second receptacle for underlying the heel portion of the sock. The footbed further includes a lip surrounding substantially the entire dimension of each of the receptacles, and the footbed is positioned so that the first receptacle matingly interfaces with the thickened ball portion of the sock and the second receptacle matingly interfaces with the thickened heel portion of the sock. The footbed also desirably includes at least one cavity, with an insert having relatively less resistance to compression than the footbed being positioned within the cavity. An outer layer of leather or other durable material is secured about a lower surface of the footbed, and side and instep portions of the sock, to define the slipper portion of the slipper sock. The outer layer preferably is constructed to provide a moccasin-like appearance.

40 Claims, 3 Drawing Sheets

SLIPPER SOCK MOCCASIN AND METHOD OF MAKING SAME

BACKGROUND OF THE INVENTION

1. Field of the Invention

The invention generally relates to a slipper sock, and a method for use in its manufacture. More specifically, the invention relates to slipper socks for providing enhanced comfort and protection to the wearer's feet, and methods for use in their manufacture.

2. Description of the Prior Art

Reinforced socks designed to be worn without shoes are commercially available in a variety of forms. For example, some socks have rubber-type treads applied to their lower surface (i.e. the floor contacting portion known as the sole), while some others have a flat leather-type sole applied to the lower surface of the sock.

In the leather-soled slipper socks, a flat piece of leather-type material is typically positioned on the bottom of the sole, and a narrow band of leather material is secured around the periphery of the sock. In such slipper socks, the leather-type material is typically secured to the sock at the terminal edge of the leather-type material overlay. Although such articles therefore provide some reinforcement of the bottom of the sock, the thin piece of leather-type material does not provide any significant protection for the wearer's foot. As a result, such products are typically limited to indoor wear, where the risk of incurring stone bruises and the like is minimized. Furthermore, when the prior art slipper socks are worn, the wearer's foot has a tendency to slip relative to the leather overlay, particularly along the sole of the article. This lateral relative motion of the sock with respect to the leather sole can cause the article to be uncomfortable when the wearer is walking, and can enable the sock to form wrinkles beneath the wearer's foot. This can in turn lead to discomfort and even the formation of blisters on the wearer's foot.

Examples of slipper socks are illustrated in the following patents:

U.S. Design Pat. No. 347,518 to Stewart illustrates a slipper sock design having a sole applied to a sock. There is no footbed illustrated, and the sole portion only extends up a minor portion of the sides of the sock, with the remainder of the design just being the sock material.

U.S. Pat. Nos. 4,276,671 and 4,317,292 to Melton describe a sock having a flat sole applied thereto; the sole does not extend over any portion of the side of the sock.

U.S. Pat. No. 3,863,272 to Guille describes a sock and bedroom slipper combination having a sock with a fibrous sole secured thereto by way of a molded side portion of flexible plastic material.

U.S. Pat. Nos. 4,852,272 and 4,907,350 to Chilewich describe a method for making a slipper sock which includes the steps of adhering a foam insert and suede outer to a sock, inverting the sock and sewing around the perimeter of the sock's sole, then turning the sock right-side-out for wearing. The foam insert is illustrated as being a flat piece of foam material.

U.S. Pat. No. 5,617,585 to Fons et al. describes a slipper sock having a rubber sole liner. The sock is embedded within the rubber liner, with a major portion of the sole of the sock not being bonded to the rubber sole, so that the bottom of the wearer's foot will contact fabric rather than rubber. The rubber sole liner terminates at the sides of the sock, and does not extend over the foot portion thereof.

U.S. Pat. No. 4,967,494 to Johnson illustrates an insulated sock having an arrangement of non-stretchable fabric combined with a plurality of panels of stretch fabric and an inner shell of insulating material. The fabrics are lined with a waterproof, breathable liner. A stretch cuff is connected to the open end of the sock.

U.S. Design Pat. No. 297,068 to Lee illustrates a design for a combined stocking and slipper. The design includes a cuffless foot covering having an arch, and protrusions along the sole.

U.S. Design Pat. No. 317,376 illustrates a slipper sock having a pointed toe and stripes along the side thereof. It does not appear to show any kind of sole overlay.

SUMMARY

With the foregoing in mind, it is therefore an object of the present invention to provide a slipper sock which provides enhanced wearer comfort.

It is also an object of the invention to provide a slipper sock which provides protection to a wearer's feet, for example, by minimizing the forces that the foot feels when stepping on stones and the like.

It is a further object, in some embodiments of the invention, to provide slipper socks which protect a wearer's feet from moisture.

In addition, it is an object of the instant invention to provide a method for efficiently manufacturing a slipper sock providing enhanced wearer comfort and protection.

These and other advantages are achieved through the provision of a slipper sock having a specially-constructed sock in combination with a shaped footbed and a material overlay defining a slipper. This unique construction enhances wearer comfort by, among other things, providing a protective footbed having a specially-constructed shape, and a sock which cooperates with the specially-constructed footbed to reduce the lateral, medial, anterior, and posterior relative motion (collectively referred to herein as "lateral relative motion") proximate the plantar surface of the wearer's foot when the wearer engages in activities such as walking.

The slipper sock of the instant invention includes a sock having at least a ball portion, an arch portion, a heel portion and an instep portion. In a preferred embodiment of the invention, the sock is in the form of a full sock for covering substantially the entire foot of the wearer as well as a portion of the ankle and/or leg thereof.

The sock desirably includes thickened padded portions on at least the ball and heel portions, with a relatively thinner arch portion being located therebetween. Socks manufactured in this manner are described in commonly-assigned U.S. Pat. No. 5,335,517 to Throneburg et al., the subject matter of which is incorporated herein by reference.

In a preferred form of the invention, the sock is knit to include a plurality of terry loops covering the inner surface of substantially the entire sock, with the thickened padded portions being formed by way of terry regions having a greater loop density than surrounding regions. Also in a preferred embodiment of the invention, the thickened padded region along the ball portion of the sock extends forwardly across the toe cap region, to define a padded toe portion. Furthermore, the thickened heel portion desirably extends rearwardly around the heel and up the Achilles region of the sock, to define a padded Achilles region for protecting the Achilles tendon portion of the wearer's anatomy.

The slipper sock also desirably includes a contoured footbed. In a preferred form of the invention, the footbed includes a first receptacle for underlying the ball portion of the sock, and a second receptacle for underlying the heel portion of the sock, with the arch portion of the footbed located between the first and second receptacles having a greater thickness than that of the receptacles. In a preferred form of the invention, the arch includes a tapered protrusion along one of its sides, with this protrusion being shaped to accommodate the arch of a wearer's foot.

The footbed also desirably includes a thickened lip surrounding substantially the entire dimension of the receptacles, with the lip having a greater thickness than that of the receptacles. The lip is desirably tapered from the outer periphery of the footbed toward the bottom of the receptacles. In this way, the lip serves to assist in stabilizing the slipper sock from relative motion between the sock and foot and the footbed, by cradling the wearer's foot in its proper position with respect to the footbed. The footbed is positioned so that the first receptacle underlies the ball portion of the sock and the second receptacle underlies the heel portion of the sock, so that the sock matingly interfaces with the footbed to assist in the stabilization of the respective elements from relative lateral, medial, anterior, and posterior motion.

The footbed also desirably includes one or more inserts positioned within cavities located on the footbed, with the inserts having less resistance to compression than the material forming the footbed proper, to enhance the cushioning of the slipper sock and thereby increase the wearer's comfort. In a particularly preferred form of the invention, at least one cavity is provided on the lower surface of the footbed (i.e. the surface remote from that having the first and second receptacles and adjacent to the sock.) For example, a generally foot-shaped cavity can be provided on the lower surface of the footbed, with a correspondingly-shaped insert being positioned within the cavity. Alternatively, a cavity can be provided on a ball region of the sole of the footbed and another cavity provided on a heel region of the footbed, with a corresponding insert being provided within each of the respective cavities. As a further alternative, the inserts could be provided on the surface of the footbed corresponding to the thickened portions of the sock, although it is preferred that they be provided on the opposite surface so that they do not interfere with the mating interfacing of the sock with the footbed. Where they are provided on the upper surface of the footbed, the cavity is preferably positioned at approximately the same location as at least one of the receptacles, so that the cavity and receptacle are integrally formed and the cavity comprises a deepened portion of the receptacle. In other words, at least a portion of the receptacle will have a depth deeper than what is needed to accommodate the thickened padded portions of the sock, with the extra depth forming the cavity. In a preferred form of this embodiment of the invention, the cavity has a dimension which is less than that of the receptacle in which it is positioned, such as one-half to two-thirds the dimension of the receptacle. As a further alternative, inserts could be provided on both the upper and lower surfaces of the footbed.

As noted, the inserts desirably have relatively less resistance to compression than the material forming the rest of the footbed. In this way, a footbed having a relatively low degree of compression can be utilized in combination with the inserts, so that a large amount of foot protection is achieved while at the same time achieving a high level of comfort due to the compressibility of the inserts. When positioned on the lower sole of the footbed, the inserts are also desirably thicker than the depth of the receptacles in which they are positioned, so that they extend outwardly from the footbed. In this way, the inserts are the first to receive the force when the slipper socks are worn while a wearer is walking or engaged in similar activities.

The footbed material is desirably very resistant to compression setting. The footbed is preferably made from an antibacterial foam material, in order to render the slipper sock resistant to the growth of undesirable bacteria and the like. The footbed material is also desirably selected so as to have a high resistance to compression, and is flexible while being slightly rigid so as to reduce the forces experienced when a wearer steps on stones and the like. For example, open cell polyurethane has been found to perform well in the formation of the footbed. It may also have a layer of fabric bonded to it as desired.

The insert is desirably made from a material having a relatively lesser resistance to compression, but also desirably has good recovery capabilities to avoid becoming compression-set. For example, it has been found that poron performs well in the manufacture of the inserts.

The slipper sock further includes an outer layer of material overlying a lower surface of the footbed, and side and instep portions of the sock, with the outer layer of material defining the slipper portion of the slipper sock. This outer layer is desirably made from natural or synthetic leather or another form of durable material, and can be treated to render it waterproof or more water resistant, as desired.

The elements of the outer layer are desirably joined together so as to simulate a moccasin or other type of footwear. The instep portion is desirably in the form of a throat plug, which is secured to the side portions of the outer layer such as by sewing. Preferably, the sewing is performed to provide a moccasin-like appearance. It has also been found to be desirable to leave the portion of the throat plug proximal to the leg of the sock free from attachment to the sock. In this way, the sock is free to stretch when the slipper sock is donned, thereby facilitating the donning process. The provision of such a throat plug has been found to assist in stabilizing the slipper sock on the wearer's foot.

The slipper sock can be manufactured in any desirable manner. In one form of the invention, the specially-constructed sock is formed, such as by knitting it on a knitting machine to include extra terry loops in the regions of extra padding. This sock is desirably positioned on a shoe last in its right-side orientation.

The footbed is formed, such as by molding (and in particular, compression molding) a foam material to obtain the desired receptacles on the upper surface. The cavities are also desirably formed on the upper receptacle-containing surface of the footbed and/or on the opposite surface of the footbed, during the molding process. To form such cavities and receptacles, the mold is specially constructed to include milled-out regions where the thickened portions of the footbed will be provided, or in any other conventional manner for producing molds. Alternatively, the footbed could be formed and the receptacles and cavities subsequently milled out, although this method would not generally be preferred due to the extra labor input required.

The outer slipper-forming layer is desirably formed by sewing or otherwise securing a sole piece to the side portions to form a three-dimensional foot covering shape. The throat plug is desirably secured to the side portions to form a slipper. An Achilles protector can also be secured to the side portion at this time.

The inserts, where utilized, are secured within their cavities, such as by cementing or otherwise adhesively attaching them to the footbed. The footbed is positioned within the slipper-forming outer layer so that it is in an overlying relationship with the sole of the slipper. The footbed and outer layer are desirably secured together, such as by way of an adhesive attachment or the like. Alternatively, the footbed can simply be retained within the outer layer through their close-fitting relationship.

The footbed-containing slipper is then positioned over the lasted sock so that the thickened padded portions of the sock matingly interface with the receptacles in the footbed. Preferably, a thin line of adhesive is applied around the inside perimeter of the side portions of the outer layer to adhesively secure the side portions of the sock to the side portions of the outer layer. The sock and outer layer are then desirably stitched together, to thereby form a completed slipper sock.

Alternatively, the footbed can be positioned on the lasted sock, and sole and side portions of the outer layer positioned over the footbed and sock. In this method, the plug can be attached prior to or subsequent to positioning of the outer layer over the footbed and sock. Preferably, in each of the manufacturing methods the throat plug is secured about a major portion of its periphery to the side portion of the outer layer as well as to the sock, while the portion thereof proximal to the leg of the sock is left unsecured, so that it is freely movable relative to the sock.

An Achilles protector (i.e. a heel kicker) is also desirably provided on the region of the sock corresponding to the Achilles of the wearer, so as to provide protection to the Achilles tendon region of the wearer's foot. Preferably, the portion of the Achilles protector positioned adjacent the side portion of the outer layer is sewn thereto as well as to the sock, and the remainder of the periphery is sewn to the sock.

The elements of the outer layer are desirably secured together using butt seams, English stitching, a roll seam, genuine hand-sewing or the like, so as to provide a desirable decorative appearance. In a preferred form of the invention, the elements of the outer layer are secured together and to the sock to simulate a moccasin or the like.

BRIEF DESCRIPTION OF THE DRAWINGS

FIG. 6*a* is a bottom plan view of the footbed illustrated in FIGS. 4 and 5, while

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
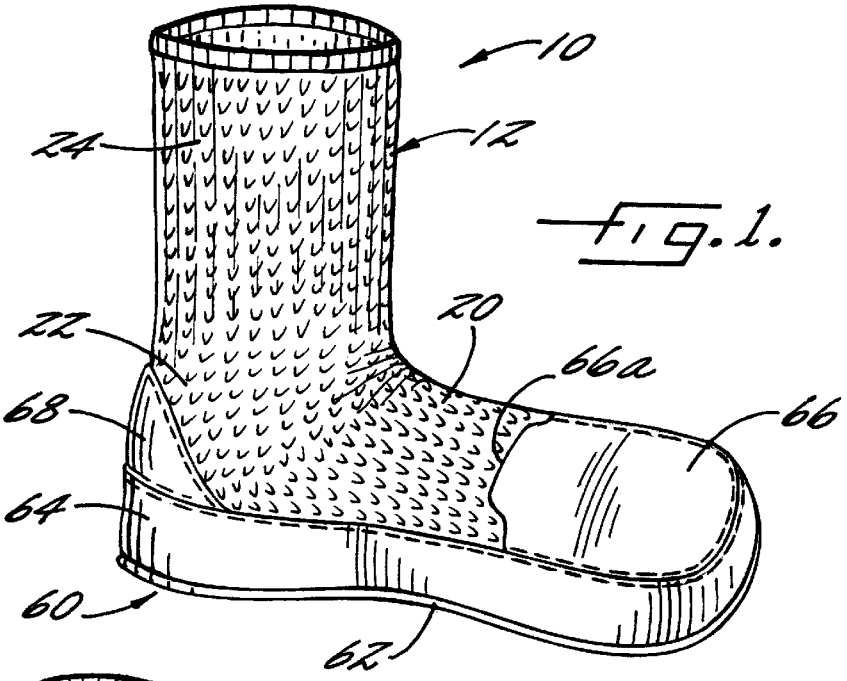
FIG. 1 is a perspective view of a slipper sock according to the instant invention.
Figure 2:
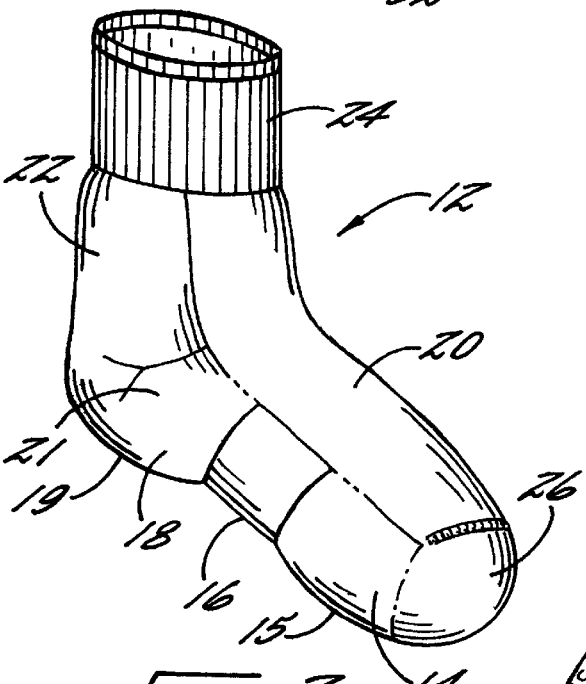
FIG. 2 is a side perspective view of a sock which can be used in forming the slipper sock of the invention.
Figure 3:
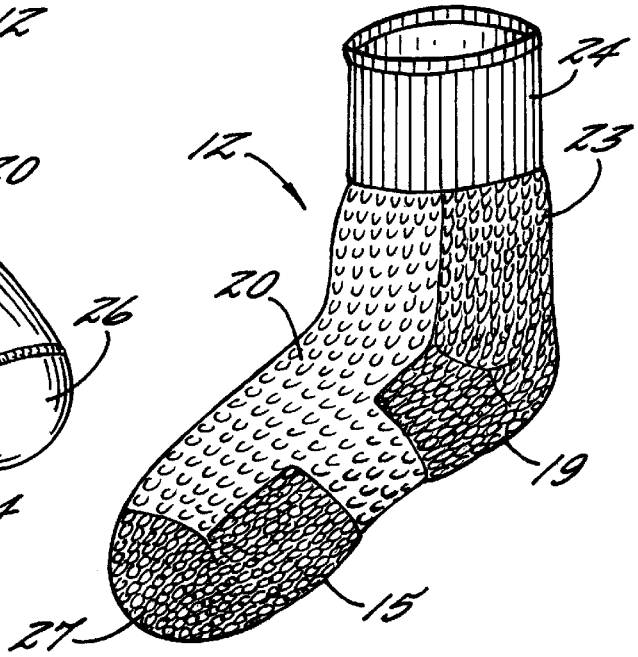
FIG. 3 is an inside-out view of the sock illustrated in FIG. 2.
Figure 4:
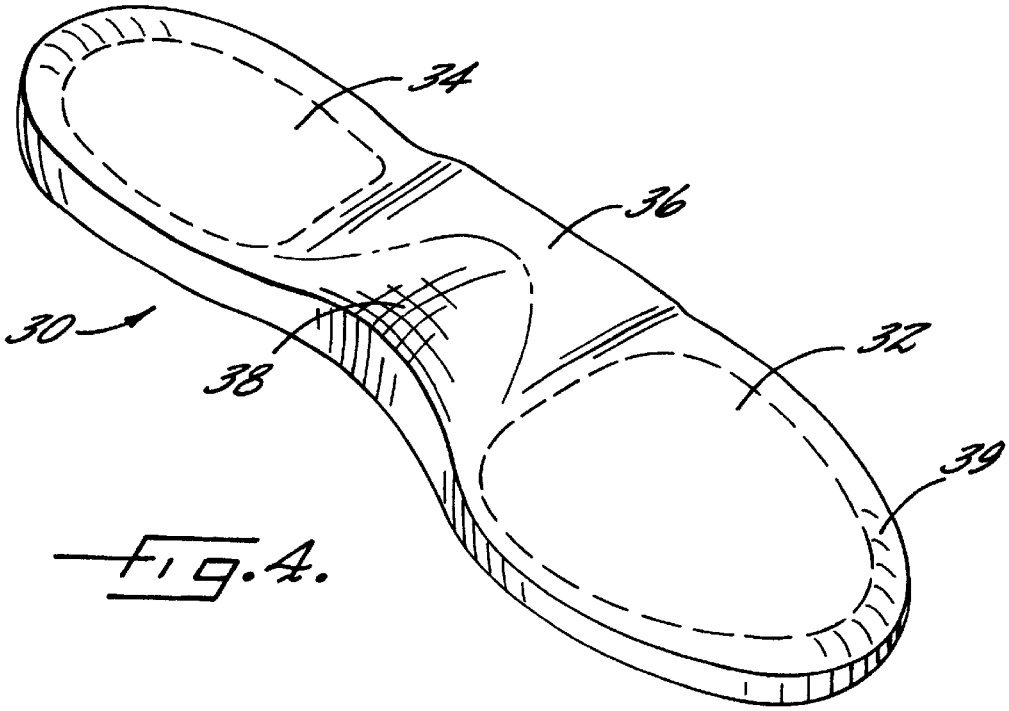
FIG. 4 is a side perspective view of a footbed which can be used to form a slipper sock for wear on a left foot of a wearer, with a footbed for a right footed-slipper being a mirror-image thereof.
Figure 5:
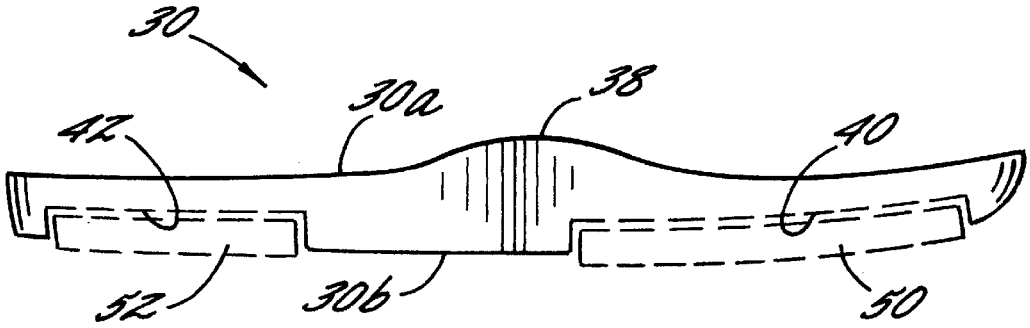
FIG. 5 is a side view of the footbed illustrated in FIG. 4.

With reference to the drawings, FIG. 1 is a perspective view of one embodiment of a slipper sock according to the instant invention and FIG. 2 is a perspective view of a sock 12 of the slipper sock. The slipper sock, shown generally at 10, desirably includes a sock 12 having at least a ball portion 14, an arch portion 16, a heel portion 18, side portions 21 and an instep portion 20, as illustrated more clearly in FIGS. 2 and 3. FIG. 2 is a side perspective view of a sock 12 which can be used in the instant invention, while FIG. 3 illustrates the sock 12 of FIG. 2 in an inside-out orientation.

In a preferred embodiment of the invention, the sock 12 is in the form of a full sock which includes an Achilles region 22 for covering the Achilles tendon area of a wearer's anatomy, a cuff 24 for covering at least a portion of a wearer's ankle and/or lower leg, and a toe pocket 26 for covering the toes of a wearer's foot. The sock 12 desirably includes a thickened padded portion 15 on the ball region 14, and a thickened padded portion 19 on the heel region 18 thereof These padded portions 15, 19 are desirably separated by the arch 16 of the sock, which is relatively thinner than the ball and heel padded portions 15, 19, respectively. As noted above, socks manufactured in this manner are described in commonly-assigned U.S. Pat. No. 5,335,517 to Throneburg et al.

In a preferred form of the invention, the sock 12 is knit to include a plurality of terry loops covering substantially the entire inner surface of the sock, with the thickened padded portions 15, 17 being formed by way of terry regions having a greater loop density than surrounding regions. For example, the relatively less padded regions could be knit in the form of a single terry fabric, while the relatively more padded regions could be knit with two terry loop-forming yarns to form a greater concentration of terry loops in the relatively more padded regions. As another alternative, relatively thicker yarns could be used to form the terry regions having relatively greater padding, while the relatively less padded regions could be knit with relatively thinner yarns forming the terry loops in those regions. Furthermore, it is within the scope of the instant invention for at least some of the relatively less padded regions to be plain knit, to be substantially free of terry loops. However, a sock 12 having substantially the entire inner surface of its foot-covering region covered with some concentration of terry loops is preferred, since this will provide greater warmth and protection to the wearer's foot.

Also in a preferred embodiment of the invention, the thickened padded region along the ball portion of the sock 15 extends forward across the toe pocket region 26, to define a padded toe portion 27. Furthermore, the thickened heel portion 19 desirably extends rearwardly around the heel and up the Achilles region 22 of the sock 12, to define a padded Achilles region. In this way, the tender Achilles tendon portion of the wearer's anatomy is protected from some forms of undesirable contact.

The terry loops also are desirably formed on the instep portion 20 of the sock 12 so that protection and warmth are provided in that region as well, although the terry loops are desirably in a lesser concentration than those forming the padded regions of the sock. Alternatively, however, the instep portion could likewise contain a higher concentration of terry loops than other portions of the sock (e.g., similar to that found in the padded ball and heel portions 15, 19), so that it further protects and warms the top portion of a wearer's foot.

The sock 12 desirably has a thickness differential from the relatively more padded regions (e.g., the ball and heel regions 15, 19, respectively) to the relatively less padded regions (e.g., arch 16) of about 1/16th of an inch. This is a relatively smaller differential from those socks described in prior commonly-assigned patents, which typically utilize a 1/8th inch differential between the relatively more padded and less padded regions. However, other thickness differentials can be used within the scope of the instant invention, as will be appreciated by those having ordinary skill in the art.

The sock 12 can be made of yarns made from any type of fibers or blends thereof; however, in a preferred form of the invention, the sock is made from a blend of wool and silk fibers. Such fibers provide a high degree of comfort and warmth to the wearer's feet, desirable moisture transport properties, and are readily available commercially. Other fibers including natural fibers such as cotton, synthetic fibers such as polyester, performance yarns such as wicking and thermal regulating yarns, and blends thereof, can also be used within the scope of the instant invention. Furthermore, the yarns can be knit or otherwise formed in any known configuration, such as with the ground yarns forming the sock being of a first yarn type and the terry loop or pile yarns being a different type of yarn. Alternatively, the padded regions can be provided in any conventional manner for forming thickened regions on a textile article.

The slipper sock 10 also desirably includes a contoured footbed, one embodiment of which is shown generally at 30 in FIGS. 4–8. In a preferred form of the invention, the footbed 30 includes a first receptacle 32 for underlying the ball portion 14 of the sock 12, and a second receptacle 34 for underlying the heel portion 18 of the sock, with the arch portion 36 of the footbed located between the first and second receptacles having a greater thickness than that of the receptacles. This arch region can be relatively flat, although in a preferred form of the invention, it includes a tapered protrusion 38 on one side which is adapted to correspond to the contours of the arch region of a wearer's foot.

The footbed 30 also desirably includes a thickened lip 39 surrounding substantially the entire dimension of the first and second receptacles 32, 34, respectively, with the lip having a greater thickness than that of the receptacles. This lip 39 is desirably tapered from a relatively thick outer edge to the bottom of the receptacle. In this way, the lip 39 serves to assist in stabilizing the foot against relative lateral motion between the sock 12 and footbed 30, by cradling the wearer's foot in its proper-position with respect to the footbed through all-around support thereof. (For purposes of this application, the term "relative lateral motion" refers to the shearing motion between the foot or sock and the footbed, and is meant to encompass motion in the side to side, medial, anterior, and posterior directions.)

The footbed 30 is positioned so that the first receptacle 32 underlies the padded portion 15 of the ball portion 14 of the sock 12 and the second receptacle 34 underlies the padded portion 19 of the heel portion 18 of the sock, so that the sock matingly interfaces with the footbed to assist in the stabilization of the respective elements from undesirable relative lateral motion. To this end, in certain embodiments of the invention it can be desirable to form the difference in thickness between the padded portions 15, 19 and the arch portion 16 of the sock to have substantially the same dimension as that of the depth of the first and second receptacles 32, 34 in the footbed 30. For example, where the dimensional difference between the relatively more padded and less or unpadded regions of the sock is 1/16th inch, the depth of the first and second receptacles 32, 34 will also desirably be about 1/16th inch. Furthermore, the length of the respective receptacles 32, 34 of the footbed also desirably approximate that of the mating padded regions 15, 18 of the sock when positioned on an appropriately sized foot, so as to provide a good mating interfacing relationship between the sock and the footbed.

Figure 6A:
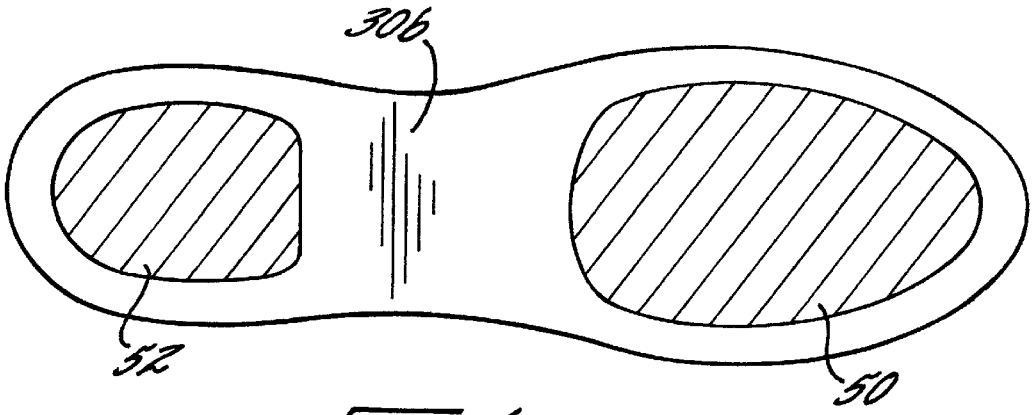
Figure 6B:
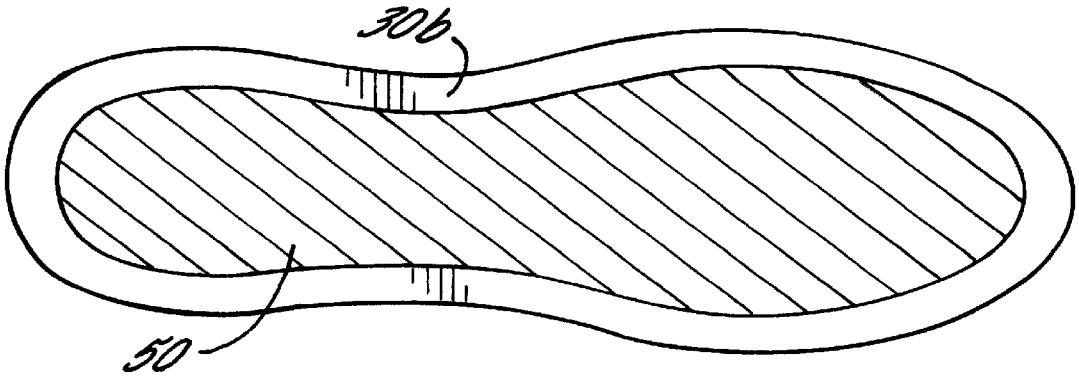
FIG. 6*b* is an alternative configuration of a footbed lower surface.

The footbed 30 defines a first surface 30*a*, which is the surface which will contact the sole of the sock 12 when the slipper sock 10 is assembled (i.e. that including first and second receptacles 32, 34) and a second surface 30*b*, which is that which will be oriented closer to the ground when the slipper sock is assembled and it is worn by a standing wearer. In a preferred form of the invention, the footbed 30 also includes at least one cavity 40 on the lower surface 30*b* of the footbed. For example, a generally foot-shaped cavity as shown in FIG. 6*b* can be provided on the lower surface 30*b* of the footbed 30 or a plurality of cavities such as shown in FIG. 6*a* (e.g., cavities 40 and 42) can be provided on the footbed, with these cavities preferably corresponding to the regions of a wearer's foot which will be positioned closest to the ground when the slipper sock is assembled and is positioned on the foot of a wearer. In this way, when the inserts are positioned within the cavities, they are located where they will absorb the most forces when the wearer is engaged in activities such as walking. Alternatively, one or more cavities can be provided on the first surface 30*a* of the footbed 30. In that embodiment, the cavities are desirably formed at a location corresponding to that of the receptacles, 32, 34, with the cavities comprising regions of the receptacles having a depth greater than that designed to accommodate the thickened padded portions of the sock. Preferably, the cavities have a smaller peripheral dimension than that of the receptacles with which they correspond (e.g., so as to be about one-half to two-thirds the size of the receptacles), although they may alternatively have a peripheral dimension approximating that of their respective corresponding receptacles.

The footbed 30 is desirably manufactured from a material which is rigidly flexible, to provide protection for the wearer's foot and a buffer to minimize injury from the wearer stepping on stones and the like. In a preferred form of the invention, the footbed is formed from a thermoplastic or polymer material such as polyvinyl dinochloride or polyurethane. For example, it has been found that footbeds having good physical properties can be compression molded from polyurethane. In particular, it is preferable that the material be one which resists compression setting, so that it retains its initial condition and shape even following repeated application of force, such as that experienced when the slipper sock is worn by a wearer while he or she is walking. The footbed is also desirably made from a material which is breathable, wicks moisture away from the foot, is washable, and includes anti-microbial agents so as to inhibit the growth of bacteria and fungi. In a particularly preferred form of the invention, the footbed is an open cell polyurethane foam such as that sold under the tradename OSP distributed by Onshore Productions of Amherst, Mass.

An insert 50, 52 is desirably positioned within each of the cavities 40, 42, with the inserts desirably being correspondingly shaped and sized to their respective cavities, so as to substantially fill the dimension thereof. The inserts 50, 52 are made from a material having less resistance to compression than the footbed 30, so that they provide a greater degree of cushioning in the regions where they are positioned. When positioned on the lower surface 30*b* of the footbed 30, the inserts are also desirably thicker than the depth of the cavities in which they are positioned, so that they extend outwardly from the footbed, as shown more clearly in FIG. 5. In this way, the inserts are the first to receive the force when the slipper socks 10 are worn while a wearer is walking or engaged in other types of similar activity.

As a further alternative, the insert(s) 50, 52 could be provided on the upper surface 30*a* of the footbed 30 corresponding to the thickened portions 15, 19 of the sock. Where the inserts are provided within cavities corresponding to the first and second receptacles 32, 34, they are desirably slightly thicker than the depths of the cavities in which they are retained, so that when the inserts are compressed by a wearer's foot, the upper surfaces of the inserts become substantially flush with the upper surface of the footbed surrounding the cavities, by virtue of the inserts having a lesser resistance to compression than that of the footbed. In this way, the inserts do not interfere with the mating interfacing between the sock and the receptacles. As a further alternative, the inserts can be provided on both the upper and lower surfaces 30*a*, 30*b* of the footbed.

The receptacles and cavities can be formed during the formation of the footbed (e.g., during a compression molding process), or they can be milled out of the footbed material. Alternatively, some of the receptacles and/or cavities (e.g., the first and second receptacles 32, 34) could be formed during the molding process, while other of the receptacles and/or cavities (e.g., cavities 40, 42) for receiving the inserts 50, 52 could be formed by milling, or vice versa. It has been found that compression molding a polyurethane foam material to provide a footbed configuration having receptacles and cavities is a particularly efficient method for manufacturing the footbed of the instant invention.

The inserts 50, 52 are desirably formed from a flexible material providing a large amount of cushioning. In a preferred form of the invention, the inserts are formed from a foam material such as poron. However, other materials having good compressibility and recovery can be used within the scope of the invention.

Figure 7:
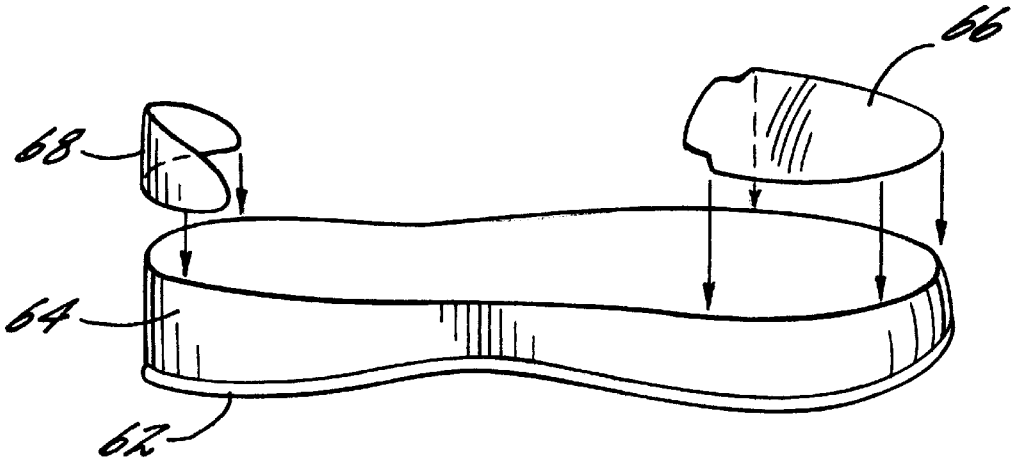
FIG. 7 is a partially exploded view of the outer layer illustrating how the elements are assembled to form the slipper portion of the slipper sock.
Figure 8:
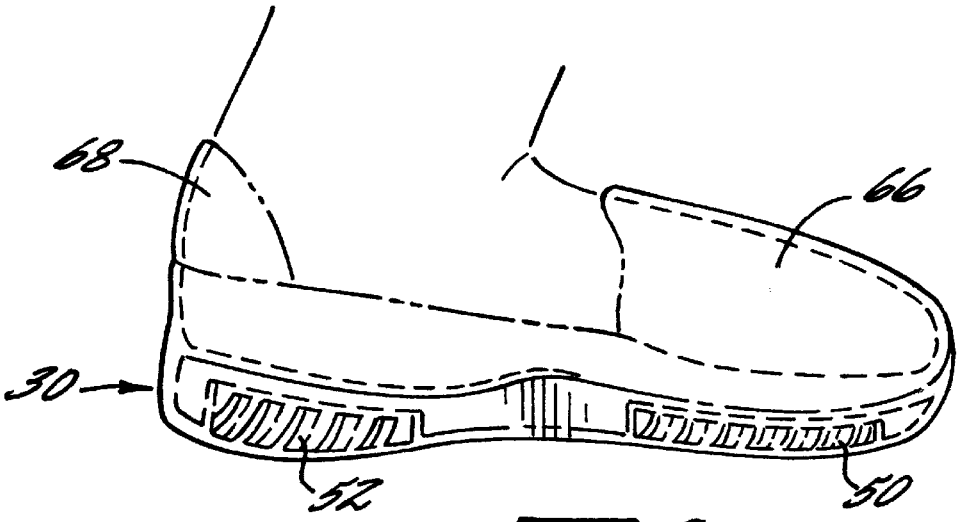
FIG. 8 is a side view of a slipper sock according to the invention, illustrating how the various elements are combined to form the finished article.

As shown in FIGS. 1, 7, and 8, the slipper sock 10 further includes an outer layer of material 60 covering a lower surface 30*b* of the footbed, and side 21 and instep 20 portions of the sock 12, with the outer layer of material defining the slipper portion of the slipper sock. This outer layer 60 is desirably made from natural or synthetic leather, although other materials can be used within the scope of the instant invention. The outer layer can be coated or otherwise treated either before or after assembly of the outer layer elements, to render it waterproof or more water resistant as desired. Furthermore, coated fabrics and the like could also be used to form the outer layer, provided they are sufficiently durable to withstand the rigors of wear.

The outer layer 60 desirably includes a generally flat sole portion 62, and a side portion 64 for extending substantially perpendicular to the sole so as to substantially surround the sides of the sock and the vertical portions of the toes. In other words, the side portion 64 extends about substantially the entire periphery of the sole portion 62. The outer layer 60 also desirably includes a throat plug portion 66 for covering a portion of the instep 20 of the sock 12; this throat plug portion is desirably generally U-shaped or otherwise shaped to provide a desirable aesthetic appearance. In addition, the outer layer desirably includes an Achilles protector 68 for covering at least a portion of the posterior of the wearer's heel and Achilles tendon region.

The outer layer elements 62, 64, 66 and 68 are secured together to form a slipper for the slipper sock, such as by sewing. The seams can be formed in any known manner, such as using an English seam structure, a roll-type seam, a butt seam, genuine hand-sewing, or the like. In a preferred form of the invention, the elements are secured together so as to provide a moccasin-like appearance, or to simulate a similar type of footwear. It has also been found to be desirable to leave the portion 66*a* of the throat plug 66 proximal to the leg of the sock 12 free from attachment to the sock. In this way, the sock 12 is free to stretch when the slipper sock 10 is donned, thereby facilitating the donning process. Alternatively, the throat plug can be sewn about its entire periphery to the sock. In addition, it has been found that the provision of such a throat plug 66 assists in stabilizing the slipper sock on the wearer's foot, by controlling the stretch of the instep portion of the sock when the wearer lifts his foot.

The slipper sock 10 can be manufactured in any desirable manner. In one form of the invention, the specially-constructed sock 12 is formed, such as by knitting it on a knitting machine to include extra terry loops in the regions of extra padding. This sock 12 is desirably positioned on a shoe last in a right-side-out orientation.

The footbed 30 is formed, such as by molding (and in particular, compression molding) a foam material to obtain the desired receptacles and cavities on the upper and/or lower surfaces. If desired, a piece of fabric can be laminated or otherwise secured to the upper surface of the footbed as well. Alternatively, one or more of receptacles can be produced by milling out material from the footbed, or in some other manner. It is preferred, however, that all of the receptacles and cavities be formed during the process of molding the footbed.

The inserts 50, 52 are desirably then secured within the cavities on the footbed, such as by cementing or some other form of adhesive attachment. However, other forms of securement could be used within the scope of the instant invention.

The outer slipper-forming layer 60 is also formed. Preferably, the sole 62 of the outer layer is sewn or otherwise secured to the side portions 64 thereof to form a generally three-dimensional shape, and the throat plug is secured about a portion of its periphery to the side portion of the outer layer. Also, an Achilles protector can be secured to a rear region of the outer slipper-forming layer, such that it will extend upwardly to cover the Achilles tendon region of the wearer's body.

The footbed is desirably secured within the outer layer, either before or after attachment of the throat plug and/or Achilles protector, such as by cementing or some other form of adhesive attachment. Preferably, an adhesive material is applied to the lower surface 30*b* of the footbed and/or the interior surface of the sole portion of the outer layer to secure the footbed to the sole portion of the outer layer. The outer layer and footbed combination are then desirably positioned on the lasted sock so that the thickened padded portions matingly interface with the receptacles of the footbed. A thin line of adhesive can be provided around an inside perimeter of the side portions 64 of the outer layer to secure the side portions 64 to corresponding side portions of the sock. The outer layer and the sock are then secured together, such as by sewing. Preferably, the outer layer is sewn to the sock along the perimeter of the outer layer, and particularly, about the perimeter of the side portion and the Achilles protector, if provided. As noted above, the portion of the throat plug 66 proximal to the leg of the sock 12 is desirably left free from attachment to the sock.

Alternatively, the sock can be positioned on a last and the footbed positioned on the sock, and the outer layer in turn positioned over the lower surface 30*b* of the footbed 30. The outer layer 60 is desirably secured in position, such as by sewing its peripheral edges to the sock, and/or by adhesive attachment. The throat plug 66 is also desirably secured to the side portion 64 of the outer layer (either prior or subsequent to its being positioned over the sock), to form an instep covering portion of the slipper portion of the slipper sock. Preferably, the throat plug 66 is secured about a major portion of its periphery to the side portion of the outer layer, while the portion 66*a* thereof extending toward the leg of the sock 12 is left unsecured, so that it is freely movable relative to the sock. If desired, the throat plug 66 can be sewn to the sock at the same time it is being secured to the side portion 64.

An Achilles protector 68 is also desirably provided on the region of the sock 12 corresponding to the Achilles of the wearer, so as to provide protection thereto. Preferably, a lower edge of the Achilles protector 68 is secured to the upper edge of the side portion 64, and the remaining periphery of the Achilles protector is sewn or otherwise secured to the sock. Also, the Achilles protector 68 is preferably secured to the side portion 64 prior to positioning of the outer layer over the footbed 30 and sock 12.

The material forming the outer layer can then be coated or otherwise treated to render it waterproof or water resistant, and the seams can be treated to render them waterproof as well in any known manner. Alternatively, a film-coated or treated material can be provided from the outset, to provide the water resisting characteristics desired. As a further alternative, a film-coated fabric could be used within the scope of the instant invention.

The resulting product provides superior wearer comfort, and enhanced protection to minimize injuries such as stone bruises. Furthermore, the slipper socks of the instant invention provide superior comfort during wear, due to the reduction in the tendency of the foot to migrate with respect to the sole of the slipper.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A slipper sock comprising:

a sock including at least a ball portion, an arch portion, a heel portion, side portions, and an instep portion;

a footbed having an upper surface defining a first receptacle for underlying the ball portion of said sock and a second receptacle for underlying the heel portion of said sock and an arch therebetween having a thickness greater than that of the footbed in the regions of said receptacles and a lip surrounding substantially the entire dimension of each of the receptacles, said lip having a thickness greater than that of the footbed in the regions of said receptacles; and an outer layer of material covering a lower surface of said footbed and covering said side and instep portions of said sock, said outer layer defining a slipper portion of said slipper sock, said outer layer being permanently fastened to said sock such that said ball portion, arch portion, and heel portion of said sock respectively overlie said first receptacle, arch, and second receptacle of said footbed and such that said slipper portion and said sock remain affixed to each other when the slipper sock is not in use.

2. A slipper sock according to claim 1, wherein said sock includes thickened padded portions on said ball and heel portions for respectively matingly interfacing with the first and second receptacles in said footbed, to thereby stabilize the foot against relative lateral movement with respect to the footbed when the slipper sock is worn by a wearer.

3. A slipper sock according to claim 2, wherein said sock further comprises a thickened padded portion in a toe box region thereof.

4. A slipper sock according to claim 2, wherein said thickened padded portions comprise a relatively greater concentration of terry loops than other portions of the sock.

5. A slipper sock according to claim 1, wherein said heel portion of said sock has a thickness which is about 1/16 inch thicker than said arch portion of said sock.

6. A slipper sock according to claim 1, wherein said sock further includes a thickened padded portion on an Achilles region of said sock.

7. A slipper sock according to claim 1, wherein said footbed is made from a material selected from the group consisting of thermoplastic materials and polymer materials.

8. A slipper sock according to claim 1, wherein said footbed is made from a polymeric material having a high resistance to compression setting.

9. A slipper sock according to claim 1, wherein said footbed is made from a first material, and further comprising a first cavity positioned within said first receptacle and a second cavity positioned within said second receptacle, said first cavity having a first insert positioned therein and said second cavity having a second insert positioned therein, said first and second inserts being made from a second material which has relatively less resistance to compression than said first material.

10. A slipper sock according to claim 1, wherein said footbed is made from a first material and includes a first cavity along its surface remote from that having said first and second receptacles, and further comprising an insert positioned within said first cavity, said insert being made from a second material having relatively less resistance to compression than said first material, to thereby provide additional cushioning when the slipper sock is worn by a wearer.

11. A slipper sock according to claim 10, wherein said first cavity corresponds to a ball portion of said footbed and further comprising a second cavity corresponding to a heel portion of the footbed on a surface thereof remote from that having said first and second receptacles, and an insert positioned within said second cavity, said insert being made from a material having relatively less resistance to compression than said first material.

12. A slipper sock according to claim 9, wherein said first material comprises an open cell polyurethane foam material.

13. A slipper sock according to claim 9, wherein said second material comprises poron.

14. A slipper sock according to claim 10, wherein said first material comprises an open cell polyurethane foam material.

15. A slipper sock according to claim 10, wherein said second material comprises poron.

16. A slipper sock according to claim 11, wherein said second material comprises an open cell polyurethane foam material.

17. A slipper sock according to claim 11, wherein said second material comprises poron.

18. A slipper sock according to claim 9, wherein each of said inserts has a thickness greater than a depth of the cavity in which it is positioned, such that upon compression of said inserts by a foot, said inserts become substantially flush with the upper surface of said footbed surrounding said cavities.

19. A slipper sock according to claim 10, wherein each of said inserts has a greater thickness than a depth of the cavity in which is positioned, such that said inserts protrude outwardly from said footbed.

20. A slipper sock according to claim 19, wherein said first cavity has a depth of about 1/16 inch and said insert has a thickness of about 1/8 inch.

21. A slipper sock according to claim 11, wherein each of said inserts has a greater thickness than a depth of the cavity in which it is positioned, such that said inserts protrude outwardly from said footbed.

22. A slipper sock according to claim 21, wherein each of said first and second cavities has a depth of about 1/16 inch and each of said inserts has a thickness of about 1/8 inch.

23. A slipper sock according to claim 1, wherein said lip on said footbed is tapered toward said receptacles to thereby cradle a wearer's foot when the slipper sock is worn.

24. A slipper sock according to claim 1, wherein said portion of said outer layer of material covering said instep of said sock is in the form of a throat plug.

25. A slipper sock according to claim 24, wherein only a portion of the periphery of said throat plug is secured to the sock.

26. A slipper sock according to claim 1, wherein said outer layer of material covers an Achilles region of the sock, to thereby define an Achilles protector therefor.

27. A slipper sock according to claim 1, wherein said outer layer of material is selected from the group consisting of natural and synthetic leather.

28. A slipper sock according to claim 1, wherein said outer layer of material includes a water-resistant coating for preventing the entry of liquids into the slipper sock.

29. A method of making a slipper sock having improved comfort comprising the steps of:

providing a sock having at least ball, arch, heel and instep portions, said ball and heel portions being thickened relative to said arch portion;

providing an outer layer of material defining a sole portion and side portions;

positioning a footbed within the outer layer along an interior surface of the sole portion, said footbed having a first receptacle for matingly receiving said ball portion of said sock and a second receptacle for matingly receiving said heel portion of said sock, and a lip surrounding substantially the entire dimension of each of said receptacles, and permanently securing said outer layer of material to at least side portions of said sock such that said outer layer and said sock remain affixed to each other during use and during non-use of the slipper sock, to thereby provide a slipper sock having enhanced resistance to relative lateral movement of a wearers foot relative to the sole of the slipper sock when the slipper sock is worn.

30. A method according to claim 29, further comprising the step of securing a throat plug to the outer layer, to thereby define a generally moccasin-shaped appearance to the slipper sock.

31. A method according to claim 29, wherein said step of positioning the footbed within the outer layer further comprises adhesively securing the footbed to the outer layer.

32. A method according to claim 29, wherein said sock includes a plurality of terry loops extending inwardly from its inside surface, with said thickened portions thereon being formed by providing a greater concentration of terry loops in that region, and wherein said step of positioning a footbed is performed so that said footbed is secured to the surface of the sock remote from that having terry loops.

33. A slipper sock comprising:

a sock having at least a sole and an instep portion;

a footbed having opposite upper and lower surfaces and overlying the sole of the sock, said footbed being formed of a foam material having a high resistance to compression-setting and having a first resistance to compression, said footbed defining at least one cavity in one of said surfaces of said footbed;

an insert positioned within said at least one cavity, said insert having a second resistance to compression less than said first resistance to compression and a thickness greater than a depth of said cavity; and an outer layer covering at least said footbed and side portions of said sock, said outer layer being permanently fastened to said sock to prevent separation of said sock and outer layer during use and during non-use of the slipper sock.

34. A slipper sock according to claim 33, wherein said sock comprises padded portions on ball and heel portions thereof, said padded portions being separated by a relatively thinner arch portion, and wherein said footbed has a first receptacle located on a ball portion of the upper surface thereof and a second receptacle on a heel portion of the upper surface thereof, and said padded portions of said sock are matingly received in said first and second receptacles.

35. A slipper sock according to claim 33, wherein said footbed includes one cavity on the lower surface remote from said sock on a ball portion thereof and a second cavity on a heel portion of the lower surface remote from said sock.

36. A slipper sock according to claim 33, wherein said footbed comprises an open cell polyurethane.

37. A slipper sock according to claim 33, wherein said insert comprises poron.

38. A slipper sock according to claim 33, wherein said outer layer further comprises an instep portion for covering an instep portion of the sock.

39. A slipper sock according to claim 33, wherein said outer layer further comprises an Achilles protector for covering an Achilles region of the sock.

40. A slipper sock according to claim 33, wherein said outer layer has the appearance of a moccasin.

* * * * *

UNITED STATES PATENT AND TRADEMARK OFFICE

CERTIFICATE OF CORRECTION

PATENT NO. : 6,308,438 B1
DATED : October 30, 2001
INVENTOR(S) : Throneburg et al.

It is certified that error appears in the above-identified patent and that said Letters Patent is hereby corrected as shown below:

Title page,
Item [56], References Cited, U.S. PATENT DOCUMENTS, insert the following:

| | | |
|---|---|---|
| -- 1,142,265 | 06/1915 | Menge, Jr. |
| 2,586,045 | 02/1952 | Hoza |
| 2,659,911 | 11/1953 | Spack |
| 2,675,631 | 04/1954 | Doughty |
| 2,926,433 | 03/1960 | Kramer |
| 3,015,170 | 01/1962 | Kramer |
| 3,035,291 | 05/1962 | Bingham, Jr. |
| 3,798,503 | 03/1974 | Larsh et al. |
| 3,801,868 | 04/1974 | Bryant |
| 3,863,272 | 02/1975 | Guille |
| 4,149,274 | 04/1979 | Garrou et al. |
| 4,276,671 | 07/1981 | Melton |
| 4,317,292 | 03/1982 | Melton |
| 4,510,699 | 04/1985 | Nakamura et al. |
| 4,541,186 | 09/1985 | Mulvihill |
| 4,616,428 | 10/1986 | Leger |
| 4,620,428 | 11/1986 | Ganon |
| 4,736,531 | 04/1988 | Richard |
| 4,852,272 | 08/1989 | Chilewich et al. |
| 4,899,412 | 02/1990 | Ganon |
| 4,907,350 | 03/1990 | Chilewich et al. |
| 4,926,568 | 05/1990 | Coffman |
| 5,012,541 | 05/1991 | Ganon |
| 5,033,144 | 07/1991 | Ganon |
| 5,335,517 | 08/1994 | Throneburg et al. |
| 5,909,719 | 06/1999 | Throneburg et al. |
| Des. 166,801 | 05/1952 | Davidson |
| Des. 297,715 | 10/1984 | Boone |
| Des. 297,068 | 08/1988 | Lee |
| Des. 317,376 | 06/1991 | McGivney |
| Des. 347,518 | 06/1994 | Stewart |
| RE. 33,018 | 08/1989 | Ostrander --. |

Item [56], References Cited, FOREIGN PATENT DOCUMENTS, insert the following:
-- WO92/19191 11/1992 (WO) --.

UNITED STATES PATENT AND TRADEMARK OFFICE

CERTIFICATE OF CORRECTION

PATENT NO. : 6,308,438 B1
DATED : October 30, 2001
INVENTOR(S) : Throneburg et al.

It is certified that error appears in the above-identified patent and that said Letters Patent is hereby corrected as shown below:

Item [56], References Cited, OTHER PUBLICATIONS, insert the following:
-- Brochure for POLYIYOU® AIR INSOLES, Jones & Vining Incorporated, Needham, MA. Brouchure for OSP® COMFORT INSOLES Keep your feet Onshore®, Onshore Productiosn. --.

Column 14,
Line 4, "wearers" should read -- wearer's --.

Signed and Sealed this

Twenty-fifth Day of June, 2002

*Attest:*

*Attesting Officer*

JAMES E. ROGAN
*Director of the United States Patent and Trademark Office*